United States Patent [19]

Corey

[11] 4,016,605

[45] Apr. 12, 1977

[54] BELT ASSEMBLY

[75] Inventor: Donald Wyman Corey, Wilbraham, Mass.

[73] Assignee: Buxton, Inc., Agawam, Mass.

[22] Filed: Aug. 13, 1976

[21] Appl. No.: 714,243

[52] U.S. Cl. ..... 2/338

[51] Int. Cl.[2] ..... A41F 3/02

[58] Field of Search ..... 2/300, 311, 221, 325, 2/337, 338, 243; 224/4 D, 4 E, 28 R, 28 A, 28 W; 69/21, 215; D2/381, 392

[56] References Cited

UNITED STATES PATENTS 3,858,244 1/1975 Mann ..... 2/338

3,905,046 9/1975 Hirsch ..... 2/338

*Primary Examiner*—G. V. Larkin

*Attorney, Agent, or Firm*—Richard A. Wise; Oistein J. Bratlie; Scott R. Foster

[57] ABSTRACT

A belt assembly featuring relatively small pieces of material, such as animal skins, comprising a plurality of octagonally shaped pieces attached to a backing strip end-to-end to form a first layer thereon, a second layer attached to said assembly over said first layer in staggered relationship.

4 Claims, 4 Drawing Figures

BELT ASSEMBLY

BACKGROUND OF THE INVENTION

1. Field of the Invention

This invention relates to belt assemblies and is directed more particularly to a belt assembly featuring small pieces of material.

2. Description of the Prior Art

It is the general practice in the belt industry to confine belt materials to those materials which are readily available in lengths substantially equal to or greater than the ordinary belt lengths. Thus, alligator belts are regularly made and sold but not so belts of smaller skins, as for example, lizard skins.

SUMMARY OF THE INVENTION

An object of the invention is to provide a belt assembly including relatively small pieces of material, such as lizard skins, which would otherwise not be deemed suitable for belt making.

With the above and other objects in view, as will hereinafter appear, a feature of the present invention is the provision of a belt assembly including a backing strip, a first layer of small octagonally shaped pieces attached to said strip and disposed end-to-end, a second layer of small octagonally shaped pieces attached to said first layer and disposed end-to-end and staggered relative to the pieces of said first layer.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an ilustrative embodiment of the invention from which its novel features and advantages will be apparent.

DESCRIPTION OF THE PREFERRED EMBODIMENT

Figure 1A:
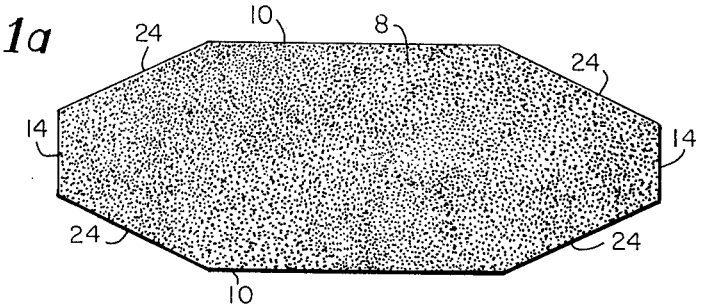
FIG. 1*a* is a bottom plan view of the belt assembly omitted from FIG. 1.
Figure 1:
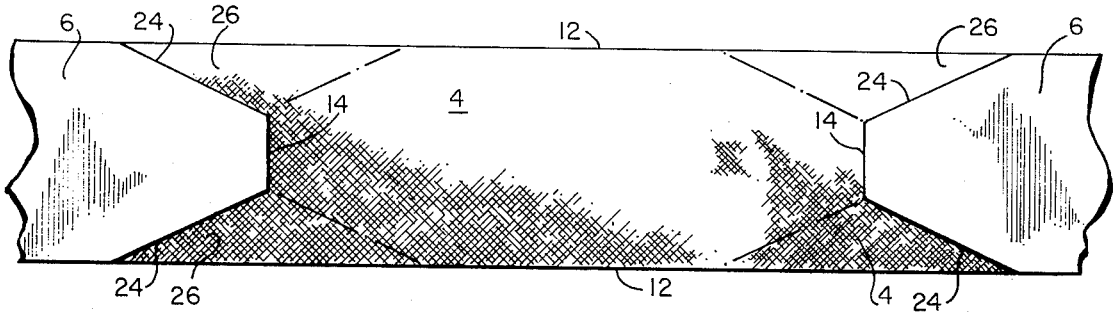
FIG. 1 is a top plan view of a portion of one form of belt assembly, less one piece, illustrative of an embodiment of the invention.

Referring to the drawings, it will be seen that the invention comprises a belt assembly 2 which includes a backing strip 4 to which is attached, as by cementing, a first layer 6 of relatively short material pieces 8 disposed end-to-end. Each of the first layer pieces 8 is octagonally shaped with two longest sides 10 coincident with edges 12 of the backing strip 4. The pieces 8 are provided with end edges 14 which are normal to the longest sides 10.

The assembly further includes a second layer 16, attached as by cementing to the first layer 6 and comprising material pieces 18 of the same configuration as the material pieces 8 of the first layer. The second layer pieces 18 are disposed end-to-end and are staggered relative to the first layer pieces 8.

Figure 2:
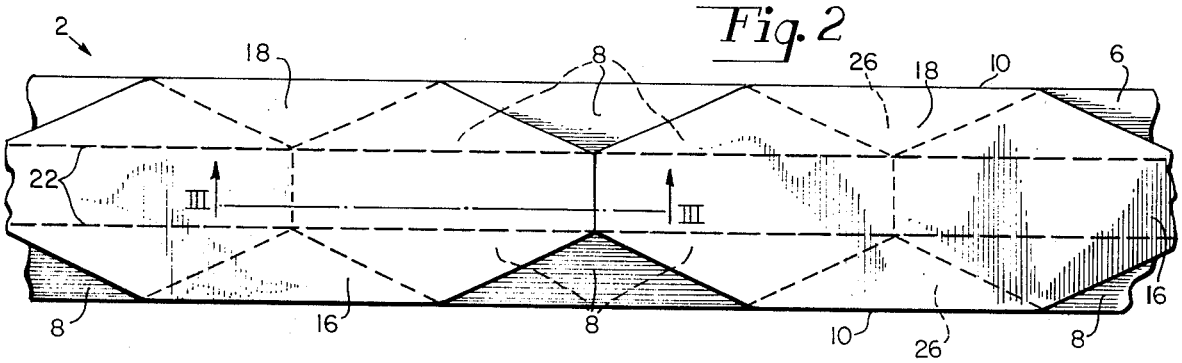
FIG. 2 is a top plan view showing the complete belt assembly.

It is preferable that the pieces 8 have quarter edges 24 so inclined as to leave exposed, after application of the first layer 6, elongated exposed portions 26 of the backing strip 4 so that a substantial portion of each of the pieces 18 of the second layer 16 is applied directly to the backing strip 4. Referring to FIG. 2, it will be seen that substantially the entire longest sides 10 of the second layer pieces are secured to the backing strip 4 in the areas of the exposed portions 26 of the backing strip. The leather pieces 18 adhere much more securely to the backing strip than to the finished surface of other pieces, therefore securing the longest sides 10 of the second layer pieces 18 to the backing strip 4 contributes substantially to the integrity of the assembly.

Figure 3:
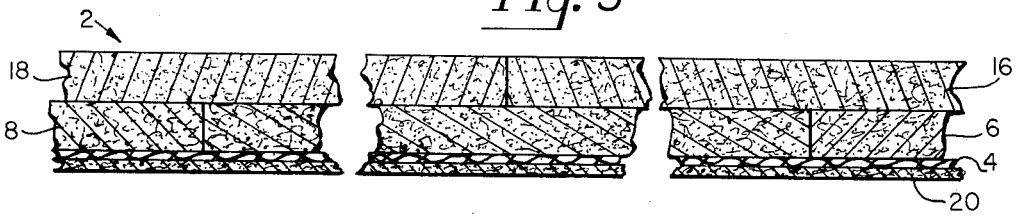
FIG. 3 is an enlarged side elevational view taken along the lines III—III of FIG. 2.

A liner 20 (FIG. 3) may be attached to the backing strip 4, if desired.

Double stitching 22 may be used to insure anchoring of the ends of the edges 14.

Thus, the end edges 14 of the first layer pieces 8 are abutting so as to protect each other from being pulled upwardly and away from the backing strip. In addition, the second layer of pieces covers the first layer so as to overlie the end edges 14 and provide protection to them. The end edges of the second layer pieces 18 abut and thereby protect each other and, in addition, may be stitched down preferably at either end of the end edges to provide further restraint against the edges being pulled upwardly.

Accordingly, pieces of material, such as lizard skins, normally too small to be of value in belt making, may be utilized in the manufacture of sturdy and attractive belts.

It is to be understood that the present invention is by no means limited to the particular construction herein disclosed and/or shown in the drawings, but also comprises any modifications or equivalents within the scope of the disclosure.

For example, the present construction could be utilized in the production of belts from scrap pieces of leather or other material, which scrap pieces are otherwise too short to be of value in belt manufacture.

Having thus described my invention what I claim as new and desire to secure by Letters Patent of the United States is:

1. A belt assembly comprising an elongated backing strip, a first layer of material attached to said backing strip, said first layer comprising a plurality of material pieces disposed end-to-end, each of said pieces being flexible and octagonally shaped with two longest sides being parallel to each other and coincident with either longitudinal edge of said backing strip, two end edges of said piece being normal to said two longest sides of said piece, a second layer of material attached to said first layer, said second layer comprising a plurality of material pieces disposed end-to-end and in staggered relation to said pieces of said first layer, said second layer pieces being flexible and of the same configuration as said first layer pieces.

2. The belt assembly according to claim 1, in which a plurality of rows of stitching is provided along a central portion of the assembly, the stitching acting to secure either end of said end edges of said pieces.

3. The belt assembly according to claim 2 including a liner attached to said backing strip.

4. The belt assembly according to claim 2 in which said pieces comprise skins of small animals.

* * * * *